US005116480A

United States Patent [19]

Palnik

[11] Patent Number: 5,116,480

[45] Date of Patent: May 26, 1992

[54] METHOD AND APPARATUS FOR ELECTROLYTIC PLATING

[75] Inventor: Karl L. Palnik, Huntington Valley, Pa.

[73] Assignee: The Carolinch Company, Ivyland, Pa.

[21] Appl. No.: 499,011

[22] Filed: Mar. 26, 1990

[51] Int. Cl.[5] ..... C25D 17/14

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 4,404,078 | 9/1983 | Francis | 204/224 R |
| 4,452,684 | 6/1984 | Palnik | 204/206 |
| 4,786,389 | 11/1988 | Moffitt | 204/206 |
| 4,818,349 | 4/1989 | Smith | 204/15 |
| 4,952,296 | 8/1990 | Wingenfeld | 204/224 R |

FOREIGN PATENT DOCUMENTS

| | | |
|---|---|---|
| 3720740-C1 | 9/1987 | Fed. Rep. of Germany . |
| 291989 | 12/1986 | Japan . |

OTHER PUBLICATIONS

U.S. application Ser. No. 07/242,300, of Kaiser, Wingenfeld, Holdt & Palnik, corresponding to German Patent No. DE 3720740-C1.

*Primary Examiner*—T. M. Tufariello

*Attorney, Agent, or Firm*—Synnestvedt & Lechner

[57] ABSTRACT

Brush plating of metal objects with noble metals is improved by using a brush body of a rigid, dimensionally stable non-porous material such as titanium which will not distort appreciably at higher temperatures, e.g. 77°-83° C., together with a porous brush insert lying along the edge of the brush which bears against the workpiece and to which the plating electrolyte is supplied through branches from a conduit through which the electrolyte flows at a controlled rate. In this system the electrolyte is supplied to the work area at an elevated temperature, e.g. 77°-87° C., with resultant increase in the speed at which higher quality plating can be performed. Special forms of anode electrode and of the electrical contact to the workpiece are preferably also employed.

9 Claims, 6 Drawing Sheets

50
75
79
88
36
26
78
84
62
48
24
34
82
78
94
74
79
90

M
16
20
10
21
22
18
14

136
154
159
158
142
120
136
90
128
131
122
118
132
140
104
102
110
114
138
204
96
101
138

210
136
132
126
131
128
118
90
140
112
114
110
153
154
152
151
159
158
158

136
140
142
126
128
90
118
112
114
110
153
154
157
156
158
260
250

292
250

294
250

250

METHOD AND APPARATUS FOR ELECTROLYTIC PLATING

FIELD OF THE INVENTION

This invention relates to method and apparatus for electrolytic plating, and especially to such method and apparatus for the brush plating of noble metals onto moving workpieces.

BACKGROUND OF THE INVENTION

It is known in the prior art selectively to plate metals, particularly noble metals, upon conductive workpieces such as metals or semi-conductors, by a process known as brush plating. Typically the workpiece is moved or wiped along a porous covering which is saturated with an appropriate metal-bearing electrolyte, while the electrolyte is maintained positive and the workpiece negative, thereby limiting the plating to the areas wiped by the porous member. This process has been adapted to mass production processes in which the brush and its electrolyte supply means are stationary and the workpieces are continuously moved along, and wiped against, the porous outer surface of the brush assembly.

Such methods and apparatus are shown and described, for example, in U.S. Pat. No. 4,452,684 of Karl Palnik, filed Mar. 11, 1983 and issued Jun. 5, 1984. In the latter type of system, the main body of the brush is typically made of a porous plastic material, which provides adequate support at temperatures below about 50° C. but which, above that temperature, tends to distort rather easily and thus present to the article to be plated a brush surface which is not straight, resulting in misplaced or otherwise non-uniform plating of the workpieces. However, it has been found that plating efficiency and speed are enhanced if the electrolyte can be maintained at temperatures in a higher range of about 50° to 83° C. Accordingly, the above-mentioned tendency toward dimensional instability of the main body of the brush of the prior art at temperatures above about 50° C. has prevented commercial operation in this advantageously higher temperature range.

Further, it has been found that it is often desirable to present different configurations of brush to the workpiece, depending upon the nature of the workpiece and upon what kind of plating is to be accomplished. For example, at times a nearly V-shaped edge on the brush may be appropriate, and at other times an edge having a rounded or flat surface, or even having a recess therein, may prove desirable. In the arrangements of the prior art, such changes in shape required complete replacement of the main body of the brush with another main body, which is extremely inconvenient, and requires an inventory of different main brush bodies suitable for different workpieces.

Further, in prior-art apparatus for brush plating, an electrolyte pressure was applied to opposite ends of a perforated electrolyte conduit extending through the brush body, to force the electrolyte outwardly from the conduit through the porous brush body to the surface, where it suffused a felt-like porous cover which in turn contacted the workpiece. The permissible rate of inlet flow of electrolyte was in this case limited, for example to about 4 liters per minute, because the brush and cover could not absorb electrolyte at a higher rate. With such relatively low flow rates, it was found that the temperature of the electrolyte dropped significantly, and somewhat uncontrollably, as it passed slowly through the conduit and outwardly through the main body of the brush. This made it difficult to achieve higher, accurately-controlled electrolyte temperatures.

In addition, the previously known brush described in the above-identified patent was not readily adjustable to plating of objects at different angular positions about the longitudinal axis of the brush e.g. above the brush as compared to beside the brush, nor was it readily and accurately adjustable with respect the distance of the brush from the path of the workpieces. Such capability is desirable to obtain the best operating conditions for any particular application.

Furthermore, in the prior art there has been room for improvement with respect to the application of the anodic voltage to the electrolyte in the brush cover, particularly with regard to efficiently and uniformly charging the electrolyte adjacent the workpiece. It has also been difficult to provide effective cathodic connection to the workpiece as it moves along the brush, and to assure positive contact between the workpiece and the brush, as desired.

Accordingly, an object of the present invention is to provide new and useful method and apparatus for the brush plating of workpieces.

Another object is to provide such method and apparatus which are operable at higher electrolyte temperatures than were previously usable in similar apparatus, thereby permitting faster electroplating.

Another object is to provide such method and apparatus in which the contacting portion of the brush can be changed easily, rapidly and inexpensively to apply different shapes of brush to the workpiece, for different purposes.

A further object is to provide such method and apparatus in which the desired high temperatures of electrolyte can be provided and accurately controlled.

Still another object is to provide an arrangement which is particularly efficient and effective as the anode in the electroplating process.

Another object is to provide an improved method and apparatus for contacting the workpiece to supply it with cathodic potential, and to assure good contact between workpiece and brush cover.

SUMMARY OF THE INVENTION

The foregoing objects are achieved in accordance with the invention by the provision of a method and apparatus according to which the body of the brush is made of a non-porous material, preferably non-porous titanium, which remains rigid and has dimensional stability even at relatively high temperatures, e.g. 77°–83° C. Preferably used in connection with this dimensionally-stable body is a porous brush insert, readily insertable and removable from the main body of the brush, and lying along the edge of the brush which bears against the workpiece. This insert provides the porous body through which the electrolyte passes to a porous outer cover and thence to the workpiece; the replaceability of the insert enables replacement not only for wear, but also to provide different configurations of the tip of the insert for use with different workpieces or in different types of plating.

Preferably the electrolyte is supplied to the porous insert by a conduit extending through the body and communicating with the surface of inner portions of the insert, and the electrolyte is applied under pressure to the inlet of the conduit and allowed to flow out of its outlet at a controlled monitored rate, thereby permitting rapid but controlled delivery of the electrolyte to the porous insert and its cover, so that the desired, relatively high electrolyte temperature can be maintained at the workpiece-contacting portion of the brush cover.

Preferably also, a platinum plating is placed around the portion of the main body which surrounds the insert where it exits from the recess in the body, to provide effective and uniform anode potential supply. In addition, a brush with electrically conductive bristles preferably bears against the opposite side of the workpiece to provide cathodic bias and to urge the workpiece into uniform physical contact with the brush.

BRIEF DESCRIPTION OF FIGURES

These and other objects and features of the invention will be more readily understood from a consideration of the following detailed description, taken with the accompanying drawings, in which.

DETAILED DESCRIPTION OF SPECIFIC EMBODIMENTS

Figures 1, 2:
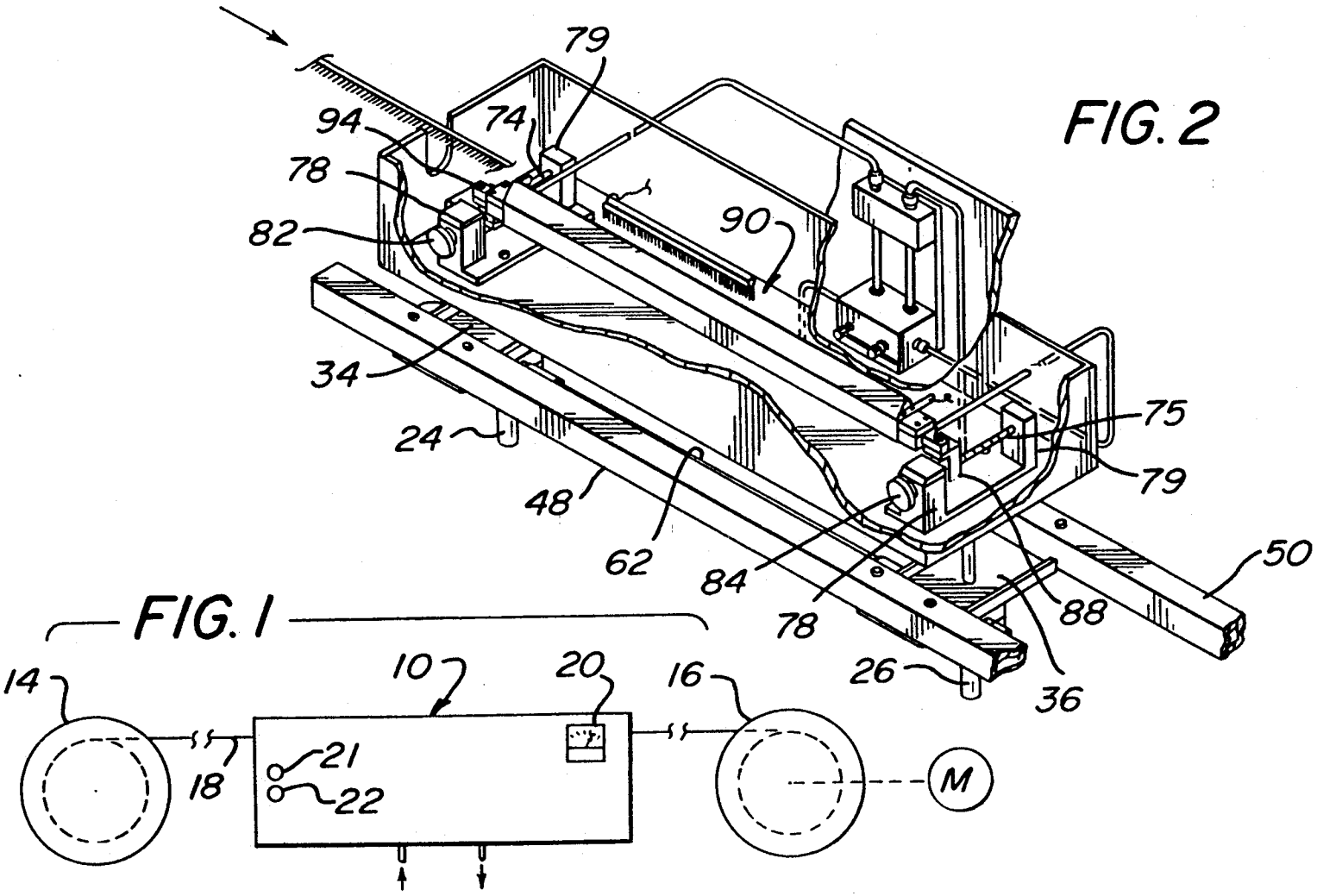
FIG. 1 is a schematic diagram illustrating an application of the invention to plating of parts of a moving workpiece.
FIG. 2 is a perspective view of plating apparatus in accordance with a preferred embodiment of the invention.

Referring now to the embodiments of the invention shown in the FIGURES by way of example only, and without thereby in any way limiting the scope of the invention, FIGS. 1 and 2 show especially clearly the overall arrangement arrangement of a system to which the invention is applicable. As shown in FIG. 1, a plating station 10 is positioned between a storage reel 14 and a receiving reel 16 between which extends the moving workpiece to be plated; typically the workpiece comprises a continuous set of metal or semiconductor parts on which noble-metal plating is to be provided in preselected locations, for purposes known in the art. In use, the ribbon from reel 14 is continuously passed to reel 16 by way if the plating compartment 10, wherein the desired selective plating is effected. A flowmeter 20 is mounted on the front of the compartment to show the difference between the rates of flow of electrolyte into and out of the main electrolyte conduit as controlled by valve controls 21 and 22, respectively, also on the front panel, all as described later herein.

Figure 3:
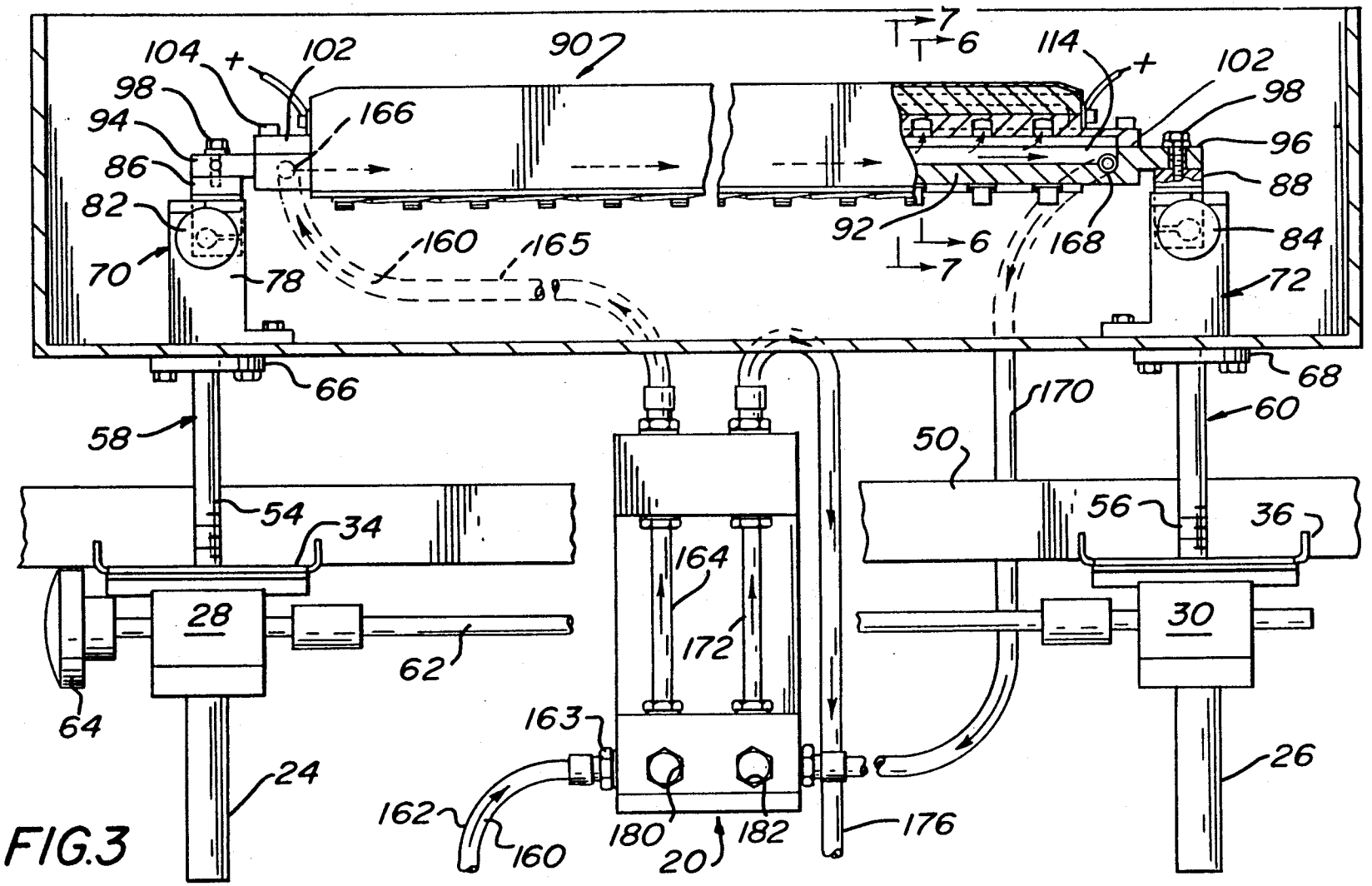
FIG. 3 is a side elevational view, with parts broken away, of apparatus in accordance with the preferred embodiment of the invention shown in FIG. 2.
Figure 4:
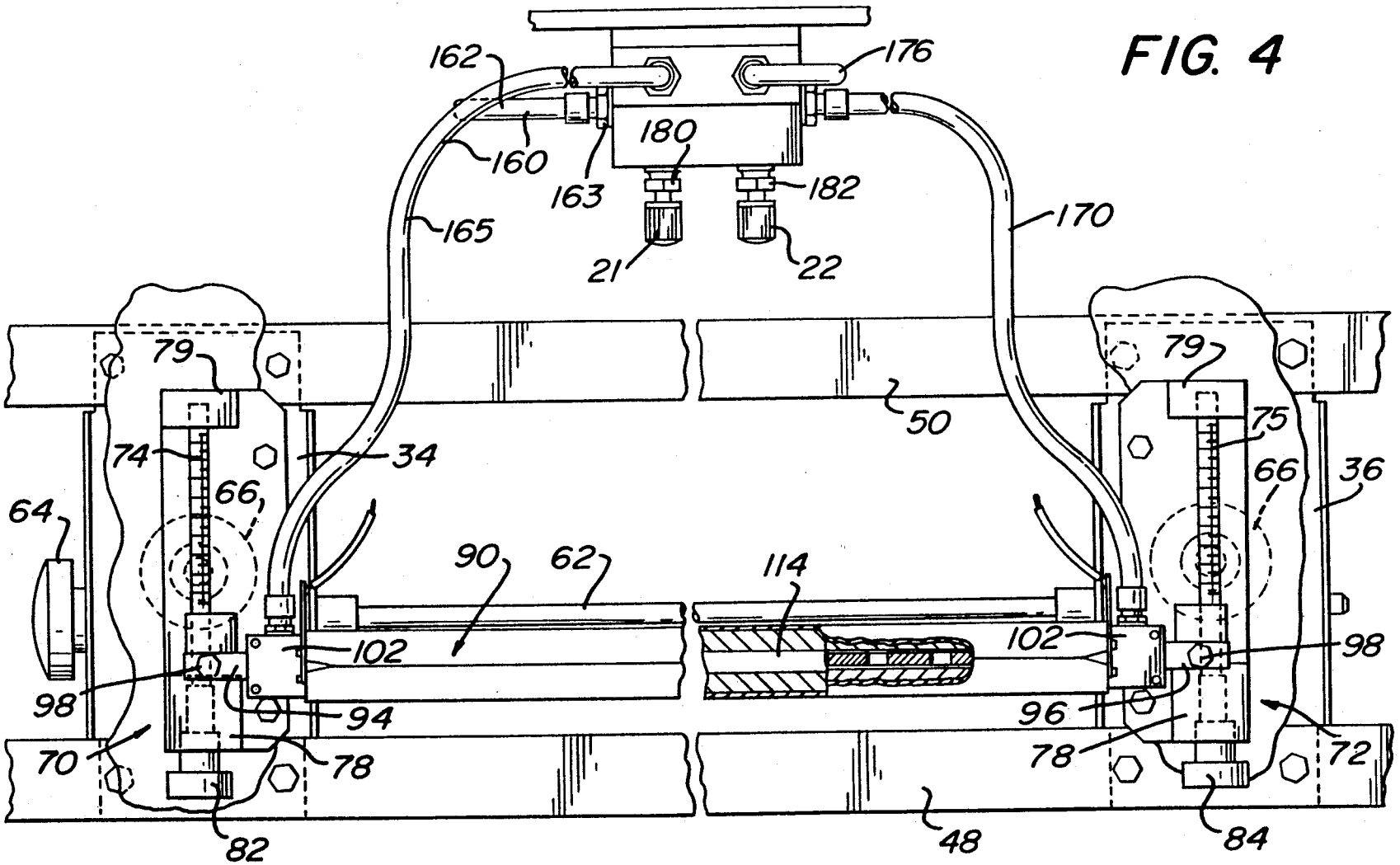
FIG. 4 is a top plan view of the apparatus of FIG. 3.

Referring more particularly to FIGS. 2–4, a main support framework is provided which comprises a pair of vertical posts 24 and 26 (FIGS. 2 and 3) provided with respective pedestal blocks 28 and 30 at their tops on which, in turn, are mounted a pair of respective trays 34 and 36. The outer ends of trays 34 and 36 are bolted to a pair of main support beams 48 and 50, which extend along the direction of the tape 18, thereby providing a rigid support framework.

Mounted within pedestal blocks 28 and 30 are respective pinions (not shown) meshing with racks 54 and 56 (see FIG. 3) on adjustable elevator posts 58 and 60. The pinions are rotatable by turning a common shaft 62 by means of knob 64, whereby both pinions are rotated identically to raise or lower elevator posts 58 and 60 together, as desired.

Elevator posts 58 and 60 are provided at their upper ends with pedestal plates 66 and 68 respectively, to the tops of which is bolted a drip pan 69 in the shape of an open-topped box. To the top of the drip pan are bolted the overlying U-shaped supports 70 and 72, respectively. The drip pan catches any excess plating solution from the main brush assembly. The U-shaped supports 70, 72 journal a corresponding pair of rotatable shafts 74, 75 in their opposite upstanding arms such as 78, 79, for rotation by manual turning of respective knobs 82 and 84. Internally-threaded travelling support blocks 86 and 88 are mounted on externally threaded portions of the shafts 74 and 75 so that the positions of the blocks along their supporting shafts can be accurately adjusted, independently of each other.

Mounted on the travelling support blocks 86, 88 is the main brush body assembly 90, shown in detail in FIGS. 5–13. As shown particularly clearly in FIGS. 3 and 5, the main brush body assembly comprises a lower sparger plate 92 having having end portions 94, 96 bolted to the tops of the travelling support blocks 86, 88 by bolts 98 passing through holes 100, 101 when the brush is oriented vertically as in FIG. 5; accordingly, the entire main brush is accurately adjustable along the direction of shafts 74, 75, by turning knobs 82 and 84.

Figure 5:
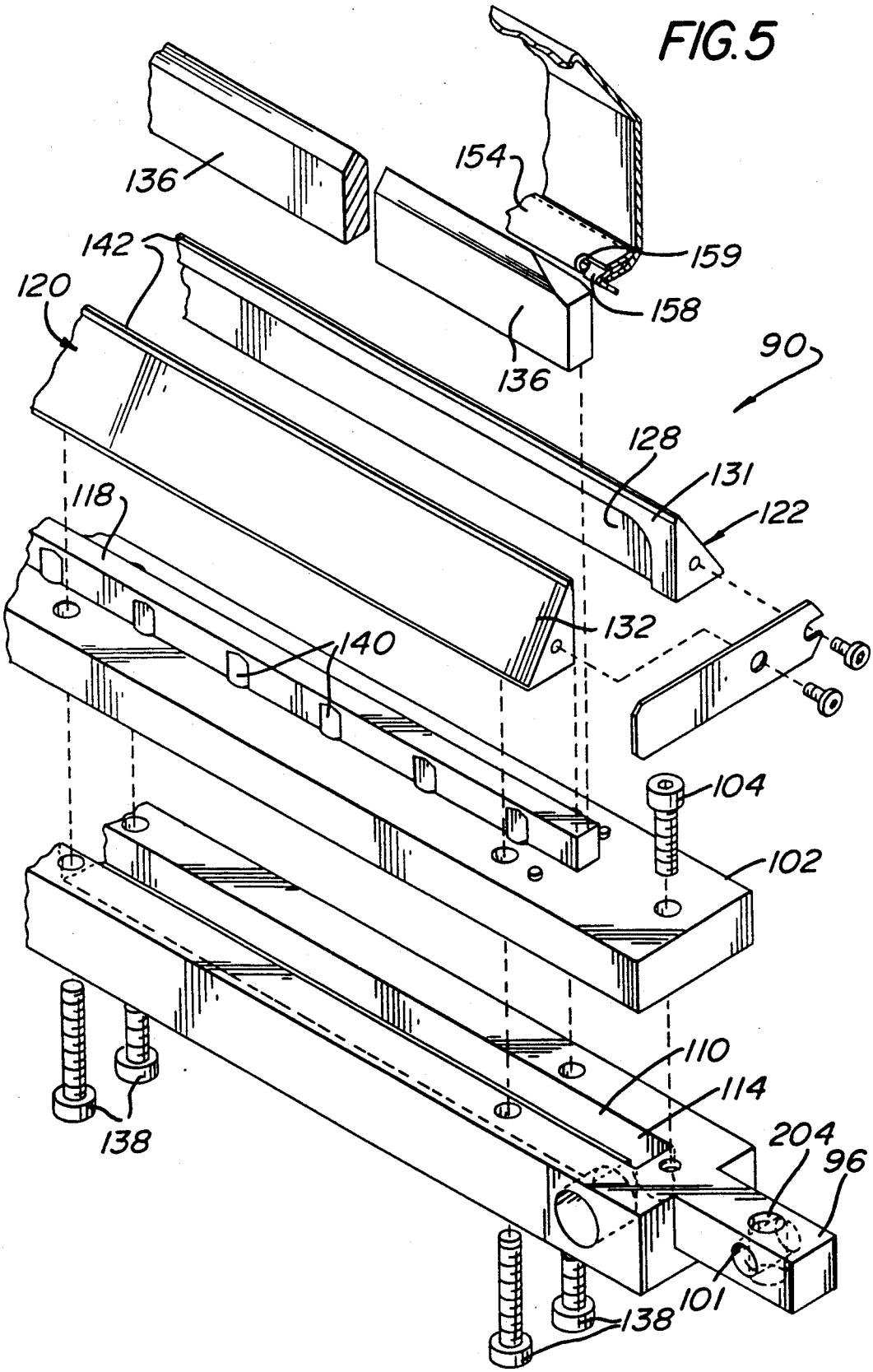
FIG. 5 is an exploded view of the main brush of the apparatus of FIG. 3.

A top sparger plate 102 overlies lower sparger plate 92 and is bolted thereto by bolts such as 104 (FIG. 5). Lower sparger plate 92 contains a trough 110 of rectangular cross-section extending along its length and opening upward, while upper sparger plate 102 contains a corresponding downwardly-facing longitudinal trough 112 (FIG. 6), aligned with trough 110 to form a longitudinally extending main electrolyte conduit 114.

Upper sparger plate 102 is provided on its upper side with a raised boss 118 of rectangular cross-section, extending longitudinally of the upper sparger plates but terminating short of both ends thereof. Clamping plates 120 and 122 of triangular cross-section extend longitudinally along the tops of upper sparger plate 102, with their vertical sides facing each other. These clamping plates extend in both directions beyond the ends of boss 118, and contain facing recesses 126 and 128 which encompass the boss 118 but leave substantial space between the boss and the interior surface of the recesses.

The top portions 130, 131 of the clamping plates are spaced apart sufficiently to receive and hold tightly the brush insert 136 (FIG. 6), which extends the length of the clamping plates; the clamping plates are held in place by bolts 138, extending upward through the upper and lower sparger plates and threadingly engaging the clamping plates.

At spaced intervals along the main electrolyte conduit 114 are bores such as 140 (FIGS. 3 and 5) formed in the upper sparger plate 102, each extending from the bottom of that plate upwardly into boss 118, but only part way through it. These bores are of a diameter greater than the width of the boss 118, so as to communicate with the interiors of the recesses 126, 128 in the clamping plates. These bores therefore constitute branch conduits providing paths for electrolyte to flow from the main conduit 114 to the outer surfaces of the lower end of insert 136, as indicated especially by the arrows in FIG. 3.

Figures 6, 7, 8, 9, 10, 11:
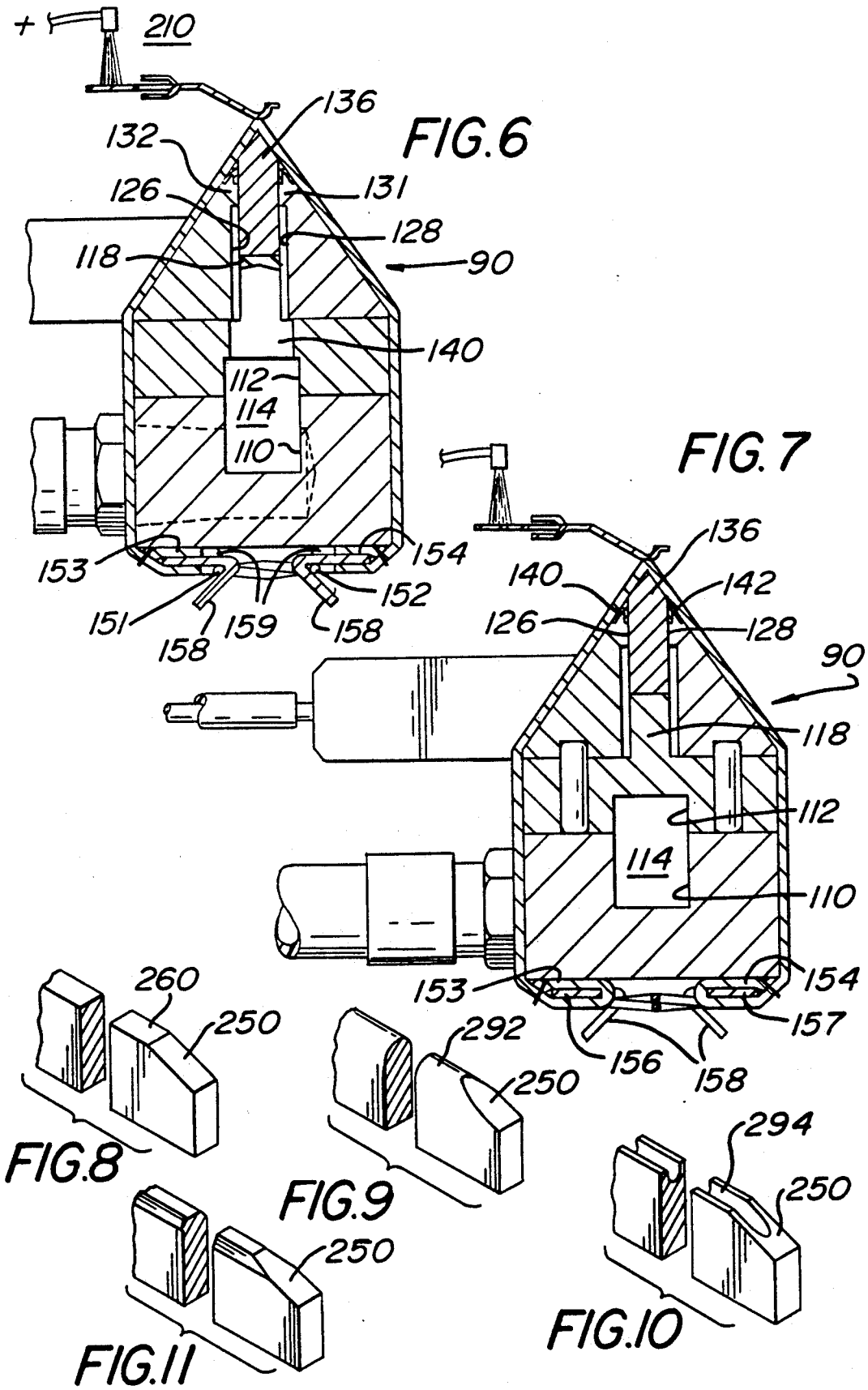
FIG. 6 is a cross-sectional view of the main brush, taken along lines 6—6 of FIG. 3.
FIG. 7 is a similar view, but taken along lines 7—7 of FIG. 3.
FIGS. 8, 9, 10 and 11 are fragmentary perspective views of various alternative configurations for the work-contacting portions of the main brush body.

The regions adjacent the top edges of the clamping plates are provided with plated electrodes 142, preferably of platinum, and over the entire main brush assembly there is provided a flexible, porous, felt-like cover 150, which wraps around the main brush assembly and in this example is secured at the bottom by criss-crossed laces 151, 152 (see FIGS. 6 and 7). As shown particularly in the upper portions of FIG. 5, hems 153, 154 are provided at the lower ends of the cover, in which a pair of corresponding strips 156, 157 are located; each strip is provided with a plurality of tabs such as 158 along its length, protruding through corresponding openings such as 159 (FIG. 5) and about which the laces are wound.

Plating electrolyte 160 (see FIG. 3) is supplied under pressure through electrolyte-supply tubing 162 to a first inlet 163 to flowmeter 20 (see FIG. 3), flows through one leg 164 of the flowmeter, thence through tubing 165 to an inlet 166 to the main electrolyte conduit 114. After passing through the main conduit, a substantial part of the electrolyte passes out of conduit outlet 168 to tubing 170 and thence through a second leg 172 of the flowmeter 20 to drain tubing 176, for return to a supply reservoir (not shown).

In series with leg 164 and leg 172 of flowmeter 20 are respective flow control valves 180 and 182, which are adjustable to control the flow of the electrolyte in main conduit 114 and in the branch conduits 140. The difference between the inlet flow rate and the outlet flow rate of electrolyte is measured by flowmeter 20 and is the rate of flow of electrolyte outward through the branch conduits 140, the insert 136 and the cover 150, a rate which is an important parameter to control in using the system in various applications.

As shown especially in FIGS. 2 and 5, anodic potential is applied to the conductive clamping plates 120, 122 and thence to plated electrodes 142 by electrodes 140 and 142, screwed to the opposite ends of the clamping plates 120, 122. Cathodic potential is applied to the workpiece 18 by means of brush contactor 210, which is maintained negative with respect to anode contact strips 186 and 188 by any appropriate DC source (not shown).

Figure 12:
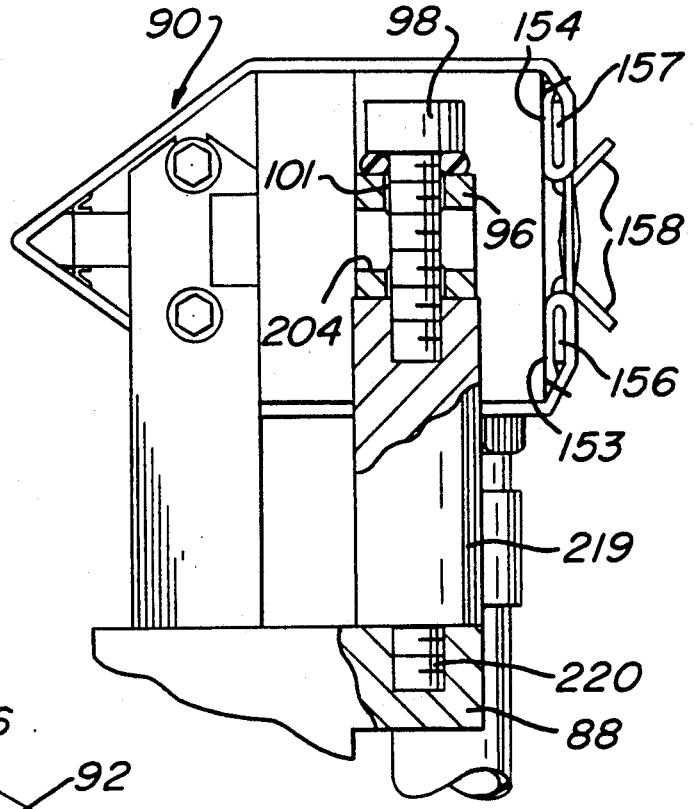
FIG. 12 is a fragmentary side view, partly in section, showing the main brush body mounted at right angles to its position in the preceding FIGURES.
Figure 13:
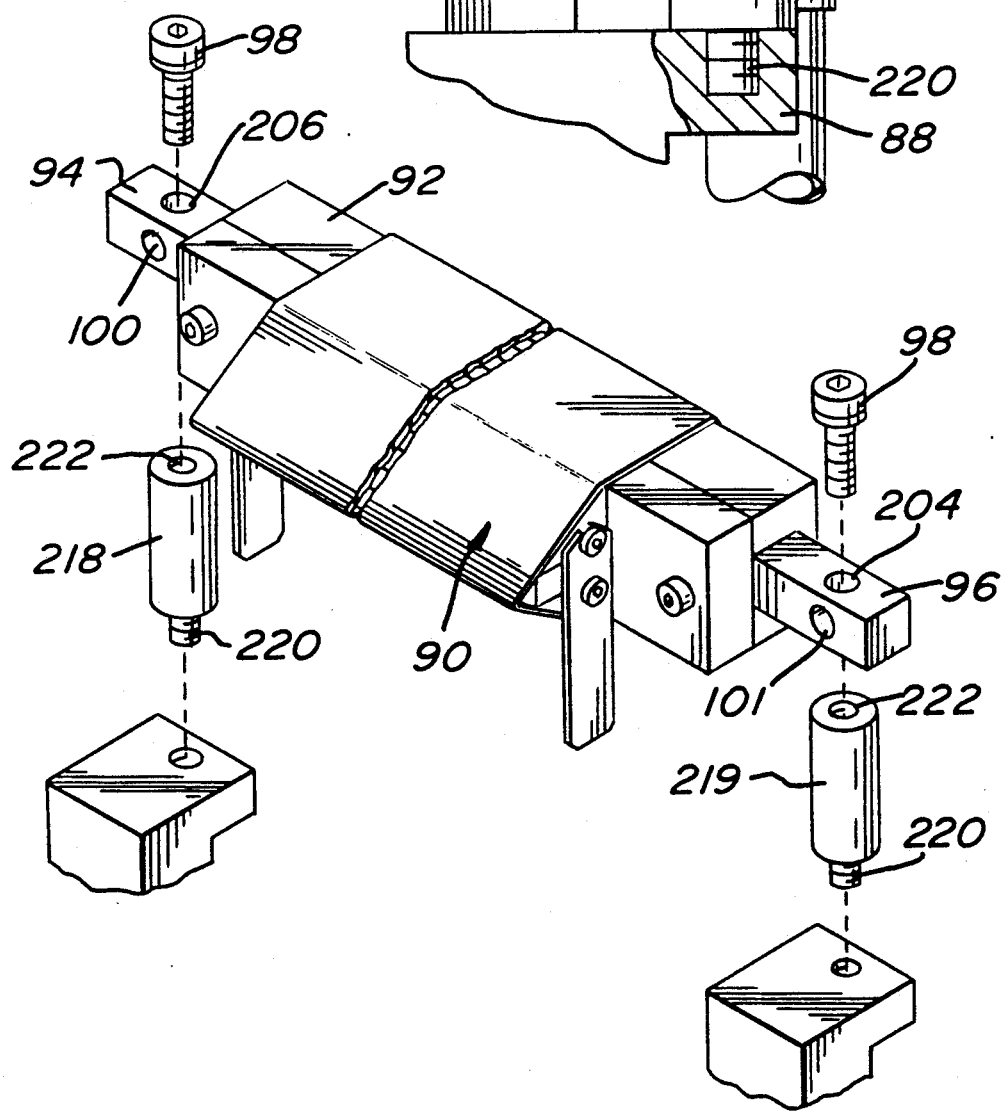
FIG. 13 is a perspective view showing the brush-mounting arrangement for the brush-body position of FIG. 12, with added spacers to position the brush appropriately.

FIGS. 12 and 13 show how the main brush assembly may be mounted at 90° from the position shown in the preceding FIGURES. End portions 94 and 96 of the lower sparger plate 92 are provided with a second set of bores 204 and 206. The mounting screws 100 and 101 are removed from holdes 100, 101 and inserted through bores 204, 206, with the main brush assembly rotated to the position shown in FIGS. 12 and 13 and with respective spacers 218 and 219 inserted between the sparger plate end portions 94, 96 and the travelling blocks 86, 88 respectively, to place the working edges of the main brush at approximately the same height as in the arrangement of the proceeding FIGURES. To enable this, each spacer is provided with a downwardly-extending screw body such as 220, and with a top threaded bore such as 222.

FIGS. 8–11 show different possible forms of insert 136. Each insert has at each of its ends a bevelled lead-in portion such as 250 to permit the leading edge of the pre-tensioned workpiece to slide up the bevel and into position along the top of the insert. In FIG. 8 the insert has a flat outer end surface 260; in FIG. 9 it has an outwardly-rounded surface 292; in FIG. 10 it has a channel-like outer surface 294, and in FIG. 11 it is trapezoidal in cross-section. By removing the bolts 138, removing one of the clamping plates, taking out the insert, and reassembling the plates with a different insert between them, any of the various types of work-contacting configuration shown may readily be provided, as well as many others.

The main brush body 90 made up of the upper and lower sparger plates 92 and 102 is of a material which remains rigid and retains its dimensional stability at temperatures well above 50° C., for example at 72°–83° C., and the electrolyte flowing through the main conduit and branch conduits is at a temperature greater than 50° C., preferably 72°–83° C. At these temperatures, the plating proceeds smoothly and more rapidly than at lower temperatures.

As an example, using a conventional electrolyte for silver plating, a preferred material for the main body (upper and lower sparger plates) and for the clamping plates is non-porous titanium. The insert 136 is a porous material, for example porous polyethelene, porous polypropylene, porous titanium or porous ceramic, preferably with about a 100 to 150 micron pore size; this insert is preferably hydrophobic when mounted with its forward edge directed upwardly, and if used with its forward edge extending downwardly it is preferably hydrophillic to retard downward flow. Because the main body retains its straight, rigid configuration, more uniform contact with the workpiece is assured even at the higher electrolytic temperatures.

In certain previously-known systems, electrolyte was pumped into the main conduit from both ends, and the flow was therefore limited to the rate at which the electrolyte was absorbed by the cover. In some cases this limited the flow rate to about 4 liters per minute, for example, producing a substantial and rather variable temperature of the electrolyte fed to the cover and the workpiece. In the arrangement of the invention, in which the electrolyte flows into, through, and out of the main conduit, the flow rate can be much higher, resulting in better control of electrolyte temperature at the work-contacting cover. As an example, the inlet flow of electrolyte into the main conduit may be about 38 liters per minute, and the out-flow about 34 liters per minute, with about 3.8 liters per minute being expelled through the porous insert to the cover. In this example, the brush contactor 210 may be about 600 mm long, and comprise bristles of stainless steel each about 15 mm long, and the plating 142 is preferably of platinum, although other inert conductive materials may be used.

Accordingly, there has been provided a brush plating system operable at temperatures well in excess of 50° C., e.g. at 73°–83° C., with a resultant higher rate of plating; the work-contacting portion of the brush body is readily changed to permit easy change of the configuration of the brush-edge contacting he workpiece; the positioning of the brush head is accurately controllable; and the plated electrodes and brush type of work contactor contribute to efficient operation.

While the invention has been described with particular reference to specific embodiments in the interest of complete definiteness, it will be understood that it may be embodied in a variety of forms diverse from those specifically shown and described.

What is claimed is:

1. A brush-head assembly for metal plating a conductive workpiece as it moves along said brush-head assembly, comprising:

a non-porous titanium brush body extending along the path of said workpiece to be plated;

means defining a liquid-flow channel extending through and along said titanium brush body and having an inlet at one end of said channel and an outlet at the other end of said channel for passage therethrough of a plating electrolyte containing metal ions;

an insertable and removable brush insert of porous material extending along the length of said brush body;

a slot in said brush body for receiving and holding the inner end portion of said brush insert with the outer tip portion thereof extending outwardly of said brush body;

means for flowing a plating electrolyte containing metal ions through said channel from said inlet to said outlet thereof;

said channel communicating with, and supplying said electrolyte to, the surface of an inner end portion of said brush insert in said slot;

platinum plating covering portions of said brush body adjacent the outer end of said slot, to serve as an anode;

a porous cover covering at least the outer tip portion of said insertable and removable brush insert, for contacting said workpiece and for applying electrolyte thereto.

workpiece-contacting brush means extending along the side of said workpiece, opposite from said same brush cover, and having conductive bristles disposed to contact said workpiece;

means for maintaining said platinum plating positive with respect to said brush bristles; and means for mounting said brush body for rotation to different angular portions about its longitudinal axis and for adjustment of the position of said brush body toward and away from said workpiece.

2. The assembly of claim 1, said means for maintaining said electrolyte at a temperature of from about 72° C.

3. The system of claim 2, comprising means for measuring the difference between the rate of flow of electrolyte into said conduit and the rate of flow out of said conduit.

4. A brush assembly for the brush plating of conductive workpieces with metal, comprising;

an elongated brush comprising a main brush body of non-porous metal material which is rigid and dimensionally stable at temperatures between room temperature and about 83° C., and having a slot extending along it containing a removable and replaceable insert of porous material;

an electrolyte-supplying conduit within said main brush body for supplying plating electrolyte to the portion of said insert lying within said slot, said conduit comprising a main conduit portion extending along said main brush body and a plurality of branch conduits providing communication between said main conduit and said porous insert;

a porous covering for the exterior of said insert to be contacted by said workpiece, whereby electrolyte supplied to said conduit passes through said insert to said covering for application to said workpiece;

wherein said main conduit has an inlet near one end thereof and an outlet near the other end thereof, and said assembly comprises means for passing said electrolyte through said main conduit from said inlet to said outlet thereof, the pressure in said branch conduits being sufficient to force said electrolyte through said porous insert to said porous covering at a controlled rate.

5. The brush assembly of claim 4, wherein said material of said main brush body is non-porous titanium.

6. The brush assembly of claim 4, comprising also a contacting brush of electrically-conductive bristles mounted adjacent, and extending along, said body for making electrical contact to said workpiece as it moves along said porous covering.

7. The brush assembly of claim 4, comprising means mounting said main body for fine micrometer screw adjustment of its position toward and away from the path of said workpiece.

8. The brush assembly of claim 4, comprising adjustable clamp means for holding said insert fixed on said slot and for releasing said insert when it is to be removed.

9. The brush assembly of claim 4, comprising means for supplying an electrolyte to said conduit and in contact with said insert, at a temperature of from about 72° C. to about 83° C.

* * * * *